US007014402B2

(12) United States Patent
Kessler

(10) Patent No.: US 7,014,402 B2
(45) Date of Patent: Mar. 21, 2006

(54) ROTATABLE FINGER ASSEMBLY

(75) Inventor: Marty Kessler, Mississauga (CA)

(73) Assignee: Sertapak Inc., Woodstock (CA)

( * ) Notice: Subject to any disclaimer, the term of this patent is extended or adjusted under 35 U.S.C. 154(b) by 0 days.

(21) Appl. No.: 10/720,695

(22) Filed: Nov. 25, 2003

(65) Prior Publication Data

US 2004/0131441 A1 Jul. 8, 2004

Related U.S. Application Data

(60) Provisional application No. 60/429,356, filed on Nov. 27, 2002.

(30) Foreign Application Priority Data

Nov. 26, 2002 (CA) ..... 2412753

(51) Int. Cl.
*B61D 45/00* (2006.01)

(52) U.S. Cl. ..... 410/155; 410/31

(58) Field of Classification Search ..... 410/31, 410/32, 43, 143, 155
See application file for complete search history.

(56) References Cited

U.S. PATENT DOCUMENTS

| | | | | | |
|---|---|---|---|---|---|
| 3,809,234 | A | * | 5/1974 | Kurick | 206/448 |
| 4,733,781 | A | * | 3/1988 | Gerlach | 211/85.8 |
| 4,919,277 | A | * | 4/1990 | Jeruzal | 211/85.8 |
| 5,037,256 | A | * | 8/1991 | Schroeder | 410/143 |
| 5,217,121 | A | * | 6/1993 | Walker | 211/41.1 |
| 5,326,204 | A | * | 7/1994 | Carlson et al. | 410/143 |
| 5,378,093 | A | * | 1/1995 | Schroeder | 410/32 |
| 5,411,234 | A | * | 5/1995 | Schoeller | 248/345.1 |
| 5,582,495 | A | * | 12/1996 | Schroeder | 410/32 |
| 5,876,165 | A | * | 3/1999 | Campbell | 410/43 |
| 6,146,068 | A | * | 11/2000 | Schroeder | 410/35 |
| 2004/0131441 | A1 | * | 7/2004 | Kessler | 410/155 |

FOREIGN PATENT DOCUMENTS

| | | | | |
|---|---|---|---|---|
| DE | 10103448 | * | 8/2002 | |
| DE | 20216430 | * | 2/2003 | |
| DE | 20302626 | * | 5/2003 | |
| DE | 10249629 | * | 5/2004 | |
| DE | 20319883 | * | 5/2004 | |
| JP | 53023488 A | * | 3/1978 | 410/32 |
| JP | 2002019929 | * | 1/2002 | |
| JP | 2004298335 | * | 10/2004 | |

* cited by examiner

*Primary Examiner*—H. Gutman
(74) *Attorney, Agent, or Firm*—Jones, Tullar & Cooper, P.C.

(57) ABSTRACT

A rotatable finger assembly including one or more fingers, supports or separators mounted for individual rotational movement from a first supporting or separating position to a second out-of-the-way position. A shaft provides an external longitudinal spline which is temporarily lockingly engageable within one of a pair of internal longitudinal radially-spaced grooves on a surrounding mounting mechanism to which the fingers, supports or separators are attachable. The rotatable finger assembly is easy and inexpensive to manufacture and is quickly adaptable for use in a variety of applications, including but not limited to spacing and/or separating items. The apparatus is also useful in the protection against damage due to contact during transportation. The assembly permits any number of rotatable fingers having the same or different profiles to be mounted quickly and easily in accordance with the desired result. The assembly can be used alone, in combination with one or more other assemblies or in combination with one or more sets of fixed spacers. Because the components of the assembly can be made or extruded in long sections which can be cut to suit, customized solutions are quickly realizable. The piecewise assembly of the components permits users to achieve a wide variety of shipping solutions to meet specific needs without necessarily having to maintain a large inventory of specific components.

16 Claims, 7 Drawing Sheets

ROTATABLE FINGER ASSEMBLY

This application claims the benefit of US Provisional Application No. 60/429,356, filed Nov. 27, 2002, the disclosure of which is hereby incorporated herein by reference. This application also claims priority based on Canadian Patent Application No. 2,412,753, filed Nov. 26, 2002.

FIELD OF THE INVENTION

The invention relates to spacers or separators used unitarily or in series for spacing or separating commercial goods or other items of interest. More specifically, the invention relates to a rotation mechanism to which said spacers and separators may be attached for controlled movement thereof.

BACKGROUND OF THE INVENTION

There is a need for a packaging structure (such as metal racks or plastic hard bins) which are or can be equipped with protective separators (foam fingers) that could be individually rotated (lock-unlock positions) for loading-unloading operations thereby avoiding complications involved with packaging structures having all fixed separators or separators which are installed after all the articles are placed therein. The invention is also driven by cost efficiencies such as by replacing individually purchased hardware as is currently done with a sequenced extrusion-type product which is piecewise assemblable to meet the needs of the specific application.

SUMMARY OF THE INVENTION

A rotatable finger assembly is disclosed having a simple structure which is easy and inexpensive to manufacture and which is quickly adaptable for use in a variety of applications, including but not limited to spacing and/or separating items. The apparatus is also useful in the protection against damage due to contact during transportation. The assembly permits any number of rotatable fingers having the same or different profiles to be mounted quickly and easily in accordance with the desired result. The assembly can be used alone, in combination with one or more other assemblies or in combination with one or more sets of fixed spacers. Because the components of the assembly can be made or extruded in long sections which can be cut to suit, customized solutions are quickly realizable. The piecewise assembly of the components permits users to achieve a wide variety of shipping solutions to meet specific needs without necessarily having to maintain a large inventory of specific components.

Accordingly, in one aspect of the invention, there is provided a rotatable finger assembly for use in spacing, separating or supporting one or more articles which comprises a plurality of independently rotatable fingers mounted about a common axis. Each finger is rotatable between a first position wherein a surface of the finger is engageable with a surface of one of the articles and a second position wherein the surface of the finger is pivoted away from the surface of the article. Each finger may also have a second surface engageable with a surface of an adjacent article. When the finger is rotated to the second position, the second surface is pivoted away from the surface of the adjacent article. The fingers may have surface profiles which conform to the portion of the surface of the article which is to be engaged. The rotatable finger assembly may include stops for limiting rotation of each finger between the first and second positions and locks for maintaining the fingers in the first and second positions.

Preferably, the fingers are removably mounted on finger mounts which are disposed on a shaft through a central aperture for rotation thereabout. The shaft has a longitudinal spline which cooperates with an internal recess extending partially circumferentially within the central aperture, which permits limited circumferential movement of the spline in the recess and hence limited relative rotational movement between the shaft and finger mount. The aperture of said finger mount may include a longitudinally extending groove at both extents of the recess in which said spline is lockingly engageable. The relative positioning of the spline, recess and grooves are such that when the spline is engaged in one groove, the finger is disposed in its first position and when the spline is engaged in the other groove, the finger is in its second position. The rotatable finger assembly may also include one or more spacers to inexpensively gap distances between fingers when larger articles are being spaced. Advantageously, two or more fingers may be joined to provide a supporting surface for one or more of said articles or a portion thereof.

Also contemplated is a transportation rack or shipping package which utilizes one or more of the aforesaid rotatable finger assemblies.

These and other features and advantages will become apparent from the accompanying description and drawings.

DETAILED DESCRIPTION OF THE PREFERRED EMBODIMENT

Figure 3A:
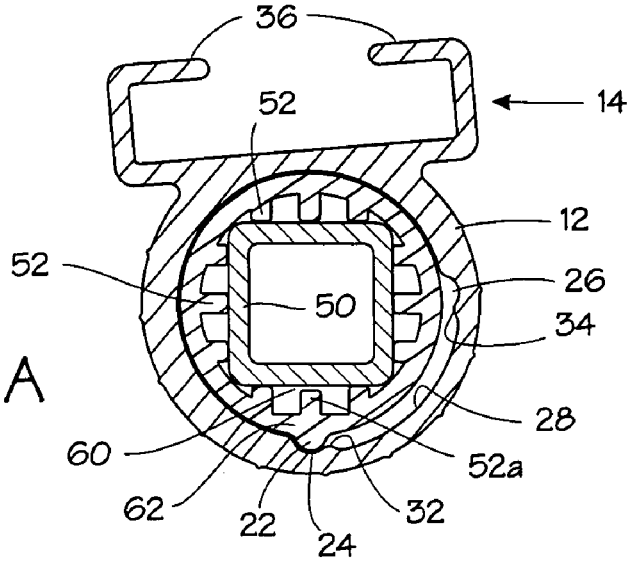
FIGS. 3A–3C are cross-sectional views of the rotating finger assembly of FIG. 1 illustrating the relative movement of the finger assembly components.
Figure 3B:
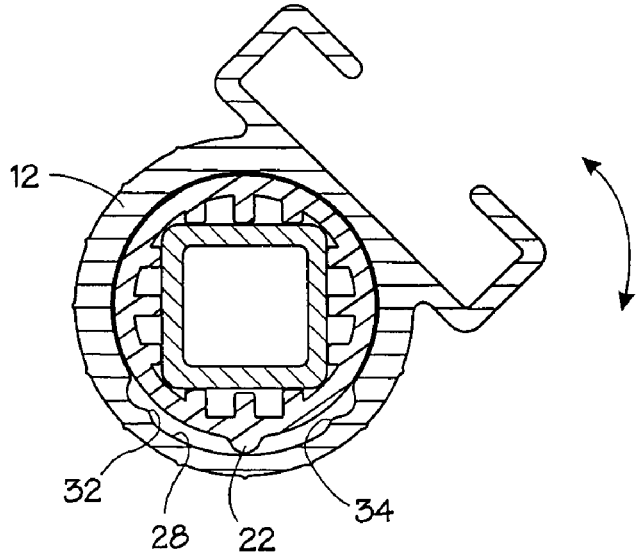
Figure 3C:
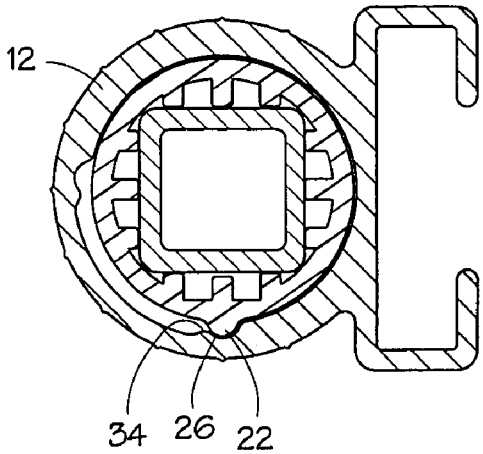
Figure 4A:
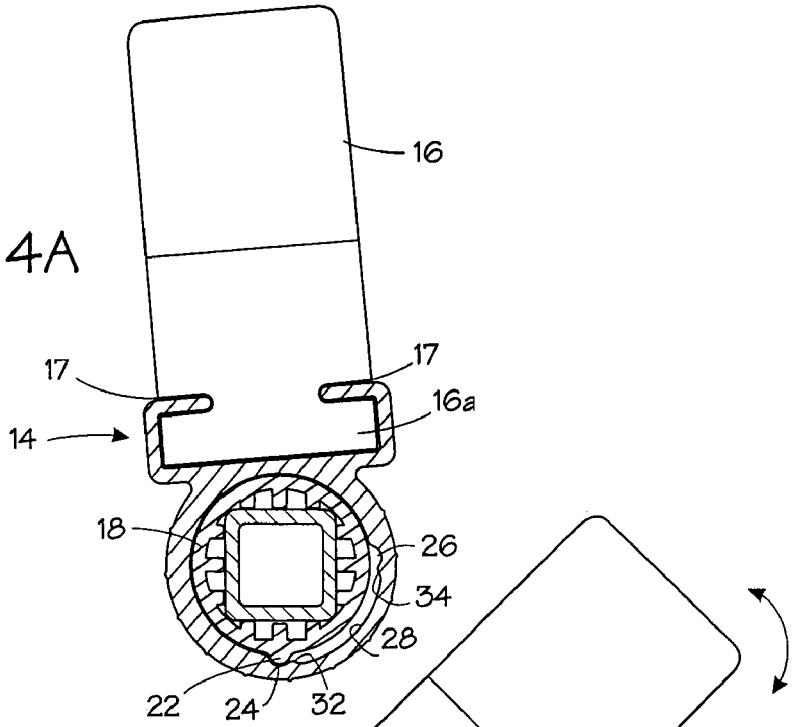
FIGS. 4A–4C are partial cross-sectional views illustrating an exemplary finger movement.
Figure 4B:
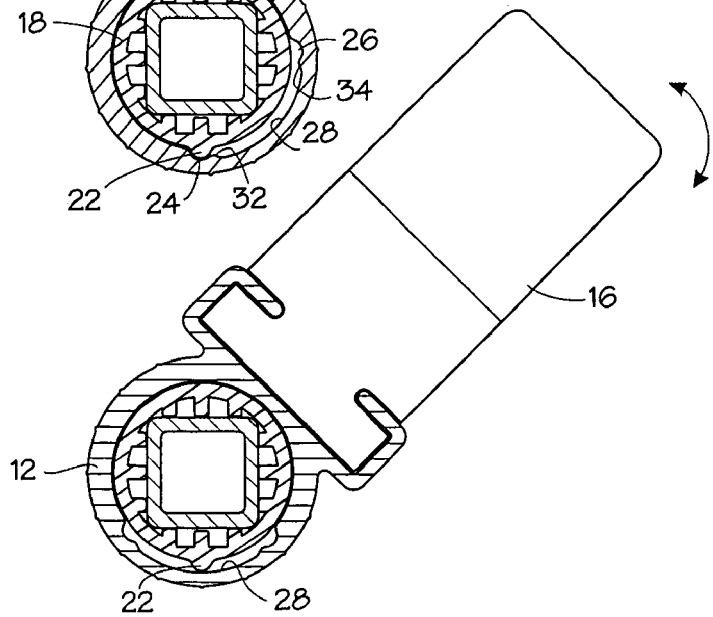
Figure 4C:
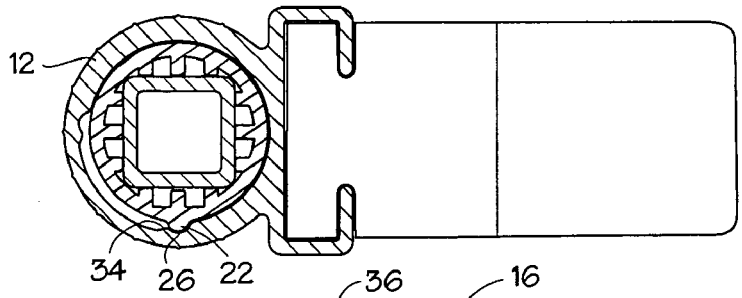
Figure 5:
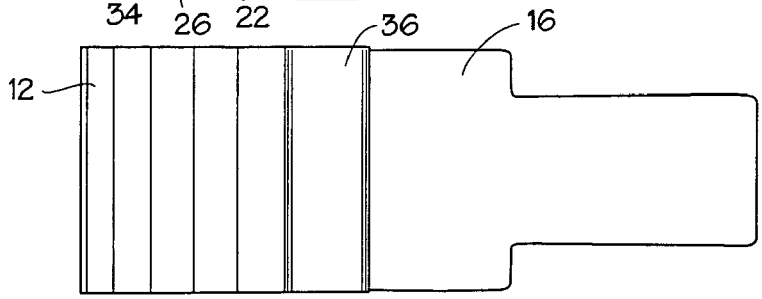
FIG. 5 is a plan view of a finger mount and finger of FIG. 4C illustrating the profile of the finger in the axial direction of the finger mounts.

Referring to FIGS. 1 and 2A to 2C, there is shown a rotatable finger assembly 10 comprising a plurality of finger mounts 12 disposed along a centre shaft 18. The finger mount 12 includes means 14 for attaching thereto a finger, spacer or the like 16 (as shown in FIGS. 4A–4C) and which will be described in greater detail hereinbelow. The finger mounts 12 have a central or generally cylindrical aperture 20 (see FIG. 2C) through which the centre shaft 18 extends. The shaft 18 has a longitudinal ridge or spline 22 which is rounded in the circumferential direction. The spline 22 is designed to seat within one of two elongated grooves 24,26 provided in the aperture 20 of each finger mount 12. Between the grooves 24,26, there is region 28 of increased diameter (as compared with the internal diameter of the remainder 30 of the aperture 20 which is slightly greater than the external diameter of the centre shaft 18) disposed between two detents 32,34 which facilitate positive registration of the spline 22 within the grooves 24,26 as can best be seen in FIGS. 3A–3C. The region 28 permits generally free movement of the spline 22 between the positioning grooves 24,26, and hence permits the finger mounts 12 to rotate accordingly with respect to the centre shaft 18. Thus, the finger mounts 12 are able to temporarily lock into predetermined first and second rotational positions with respect to the centre shaft 18 as determined by the radial placement of the grooves 24,26 as shown in FIGS. 3A and 3C.

As shown in FIGS. 4A–4C, the finger attachment means 14 may comprise a generally C-shaped channel with flanges 36 into which can be slid a similarly configured end portion 16*a* of a finger, spacer or the like 16, for retention therein by way of friction fit or by adhesive or mechanical fastening means if necessary. By utilizing a friction fit, the fingers 16 can be readily changed for a finger with a different profile to meet the requisite spacing needs. The finger 16 includes a pair of slots 17 into which the flanges 36 of C-channel 14 engage. It will be appreciated that the manner by which the fingers are attachable can be varied.

Figure 1:
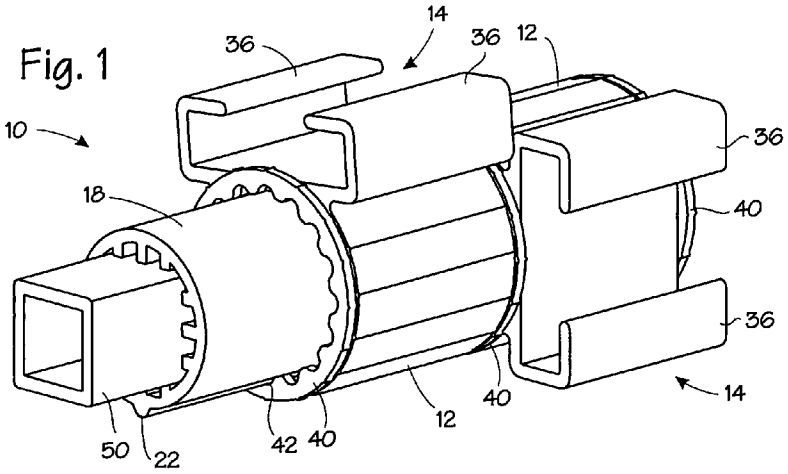
FIG. 1 is a perspective view of the rotatable finger assembly which has been broken away to reveal the details and structure thereof.
Figure 2C:
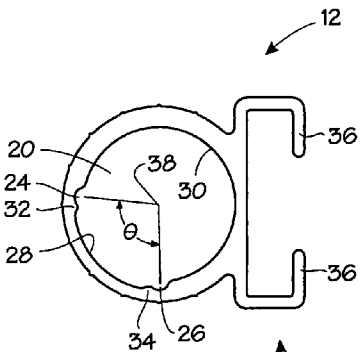
FIG. 2C is an end view detail of a finger mount of the finger assembly of FIG. 1.
Figure 2B:
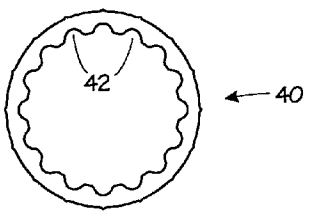
FIG. 2B is an end view detail of a spacer of the finger assembly of FIG. 1.

Because the forces which may be applied to the finger 16 for moving it rotationally into and out of spacing position would typically be in a circumferential direction, the channel 14 is preferably disposed so that its length (perpendicular to the page as shown in FIG. 2C) is in the same general direction as the axis 38 of the aperture 20 of the finger mount 12, as shown in the drawings.

To reduce friction and to ensure smooth rotational movement of adjacent finger mounts 12, a spacer 40 (see FIGS. 1 and 2B) may be employed between each adjacent pair of finger mounts 12 and/or at the outermost finger mounts 12 disposed on the centre shaft 18. The spacer 40 can be provided in a variety of axial lengths to suit the specific application or finger spacing requirement. Depending on the fit between the internal diameter of the spacer 40 and the external circumference of the centre shaft 18, the spacers 40 can be used as axial positioners for the finger mounts 12. The spacers 40 can be of any suitable material such as nylon, Teflon™ or the like, although extruded PVC is preferred due to its inexpensiveness and suitability to being cut to whatever axial length is desired. Due to the external shape of the centre shaft 18, one or more grooves 42 may be provided on the inner perimeter of the spacer 40 to accommodate the spline 22 of the centre shaft 18. The more grooves 42 that are provided, the easier the registration of the spline 22 with one of them is during assembly.

Figure 2A:
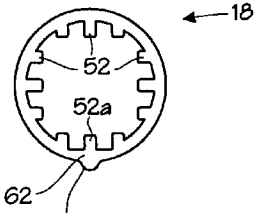
FIG. 2A is an end view detail of the centre shaft of the finger assembly of FIG. 1.

To facilitate manufacture of the spline 22 on the centre shaft 18 the centre shaft 18 is preferably extruded in an appropriate cross-section, such as is shown in FIG. 2A. PVC makes an inexpensive and sufficiently rigid material and enjoys low friction so as to facilitate relative movement of the spline 22 and the portions of the finger mount which it contacts. Preferably, the internal cross-section of the centre shaft 18 is such that it can accommodate a rigid, non-round mounting tube 50, preferably made of a relatively high strength but inexpensive material such as steel. The non-round construction of the tube 50 permits positive engagement with the centre shaft 18 so as to resist relative rotational movement therebetween. This two-piece construction is very economical as compared with a unitary structure of similar strength and performance. The mounting tube 50 also serves to enable the rotatable finger assembly to be mounted adjacent the articles to be spaced/separated. In this regard, the mounting tube 50 can extend axially beyond both the centre shaft 18 and outermost finger mounts 12, whereby the protruding ends can be used for support and/or structural connection. A hollow tube is preferred over a solid structure due to cost and weight considerations. Additionally, advantage can be taken of the tube's aperture for connection/mounting purposes.

As can be seen in FIGS. 2A and 3A, the internal cross-section of the centre shaft 18 approximates the preferably square cross-sectional shape of the tube 50. In this regard, four sets of prongs 52 project inwardly and against which the tube 50 abuts. Preferably, the fit is such that the tube 50 can be inserted and retained within centre shaft 18, but also removed when necessary. The pronged profile has been found to be a good compromise between strength and reduced weight and does not necessarily require the tolerances of a completely square hole.

At least one of the finger mount 12 and the centre shaft 18, or respective portions of each, should be sufficiently resilient to permit relative deflection of the spline 22 over detents 32,34, but also sufficiently stiff or inflexible so as to prevent relative over-rotation of the spline beyond the grooves 24,26 (i.e. into the reduced diameter portion 30). If as aforesaid, the centre shaft 18 is made from a PVC extrusion, the finger mount can then be made from a relatively more rigid material, such as extruded aluminum, to provide the necessary strength for the fingers 16. If necessary, a small space 60 (see FIG. 3A) can be provided for between the inner prong 52*a* adjacent the spline 22 to facilitate deflection of the portion 62 of the centre shaft 18 near which the spline 22 is disposed. The resiliency in the components and or the spacing 60, if provided, in connection with the height of the detents 32,34 and the diametral differences between portions 28 and 30, are selected with an eye to not permitting the finger mount 12 from rotating beyond the range dictated by the radial angle θ between the grooves 24,26.

In the embodiment shown, the grooves 24,26 in the finger mount 12 are separated radially by more than 90° in order to ensure the finger can be moved (effectively pivoted) from a first position, for example a horizontal position (see FIG. 4C) wherein the finger acts as a spacer between two articles, to a second position (see FIG. 4A) which would be sufficiently beyond vertical to ensure the finger is moved fully away from the articles to be spaced to enable their removal vertically or laterally (i.e in the axial direction of the shaft 18).

The configuration of the fingers 16 is highly variable and a number of different profiles can be on hand to accommodate a wide variety of spacing/separating situations. However, custom profiles can always be provided for specific applications.

The various components can be selected and assembled on an as-needed basis or predetermined configurations can be pre-assembled for installation as required.

Figure 6:
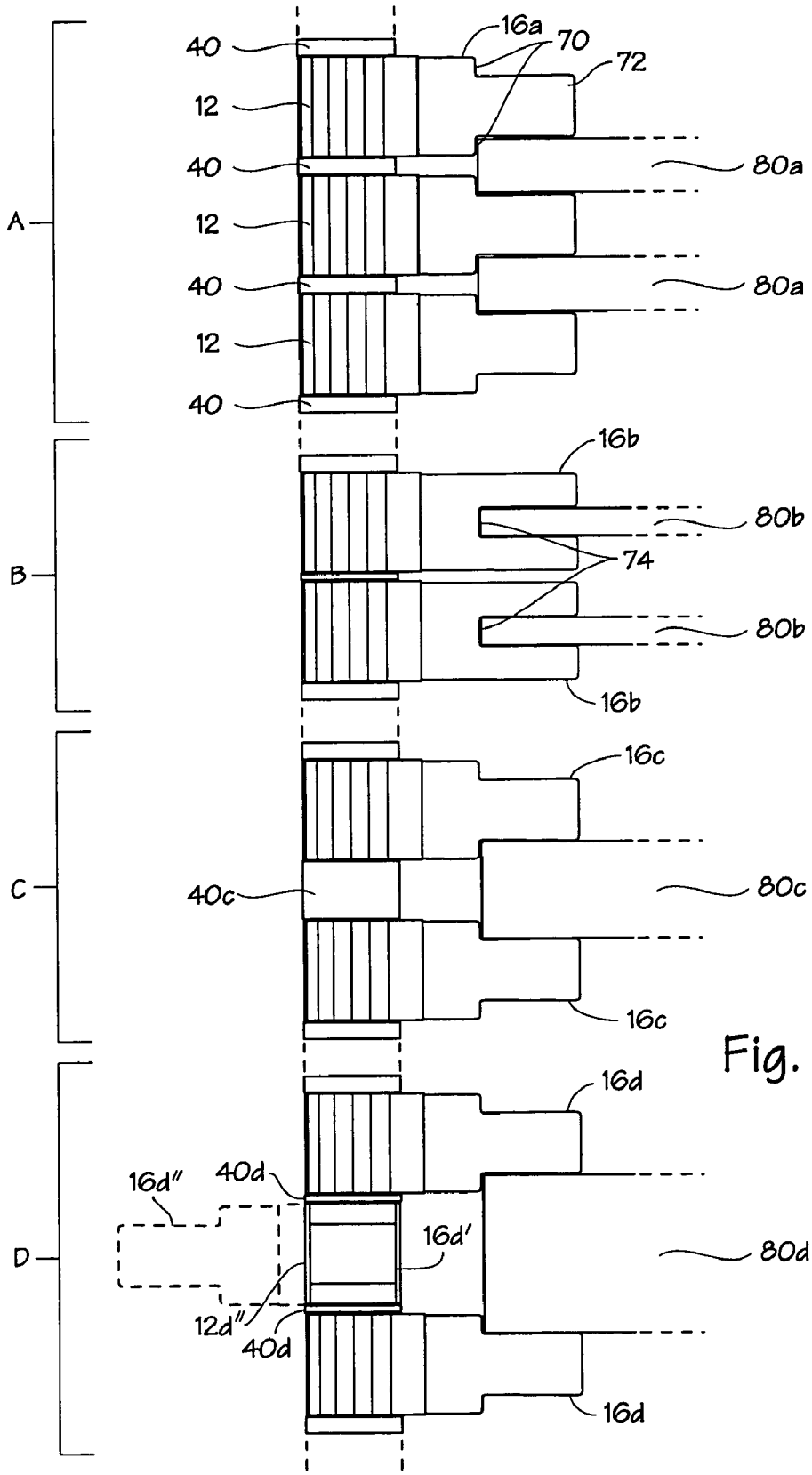
FIG. 6 is a plan view of a length of finger assembly illustrating various finger profiles and how they can be employed to separate and/or support a variety of goods.

FIG. 6, which is indicative of the variability of the assembly, shows an indefinite length of assembly having four exemplary arrangements or series of fingers A,B,C,D. In series A, a plurality of finger mounts 12 are separated by spacers 40. Each finger mount has a finger 16*a* attached thereto. The profile of the fingers 16*a* in series A, which is generally the same as finger 16 shown in FIGS. 4A–C and 5, has a shoulder 70 which is transverse to the axis 38 of the finger mount 12 disposed on each side, resulting in a section 72 of reduced axial width (axial is with respect to the axis 38 of the finger mount 12). Articles 80*a* are spaced apart by the reduced axial width section 72 while being individually retained between reduced axial width sections 72 and respective shoulders 70 of adjacent fingers 16*a*.

In series B, the profile of fingers 16*b* includes a slot 74 disposed transversely to the axis 38 of the finger mount 12. Articles 80*b* are accommodated within slots 74. With this arrangement, the width of the slot 74 has to be generally the same (or slightly greater) than the thickness of the article 80*b*, which can limit adaptability when accommodation of articles of various thicknesses is required as each article would require a finger 16*b* with a matching width slot 74. As can be seen in Series C, the fingers 16*c* are the same as those of series A, but simple variation in the axial length of spacer 40*c* advantageously permits accommodation of a wider article 80*c*. Similarly, the axial length of the finger mounts 12, the axial width of the fingers 16, the width of reduced section 72 and/or the depth of shoulder 70 can all be varied to suit almost any spacing requirement.

Alternatively, spacing and support for an article 80*d* may also be provided by selectively employing only certain fingers 16*d* as shown in series D. In this case, the middle finger 16*d*' is not utilized, i.e. it remains locked in its generally upright position. With the appropriate axial length of spacers 40*d* (which length need not be the same), the selected fingers 16*d* are positionable adjacent opposed edges of the article 80*d* so as to retain the article 80*d* therebetween.

It is also possible to orient one or more of the finger mounts 12*d*" oppositely on the centre shaft 18 during assembly such that the rotational action of finger 16*d*" occurs in the opposite direction as shown in phantom in series D. In this manner, a single assembly could be employed to separate articles disposed on either side of it.

It will be understood that while the finger profiles shown in FIG. 6 have generally square shoulders 70 or rectangular slots 74, the fingers can be made with other shapes to suit the edge shape of the article to be separated, if desired.

Figure 7A:
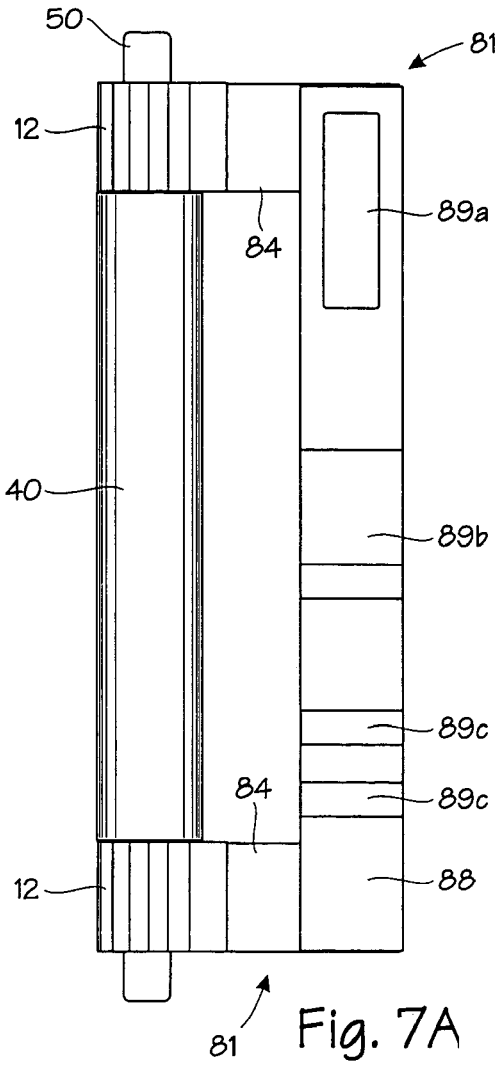
FIG. 7A is a plan view of an alternate finger arrangement.
Figure 7C:
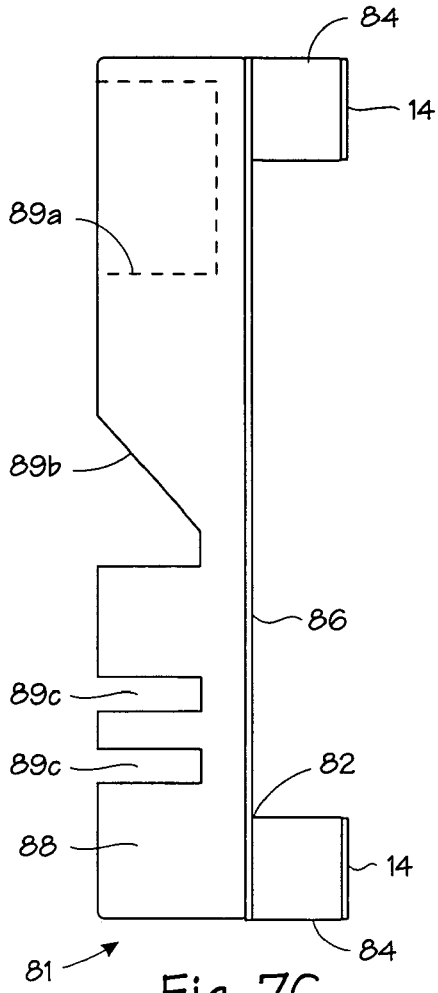
FIG. 7C is a side view of the alternate arrangement of FIG. 7A.
Figure 7B:
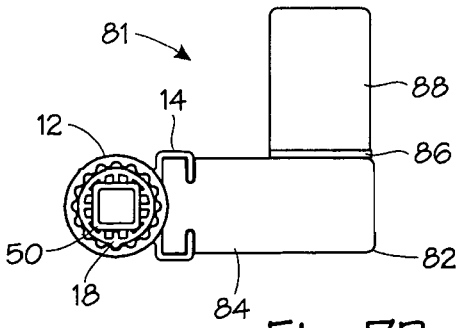
FIG. 7B is an end view of the alternate arrangement of FIG. 7A.

Depending on the need, the rotatable finger assembly can also be adapted as shown in FIGS. 7A–7C to function as a support/separator 81 by substituting a support frame 82 for two or more fingers. Frame 82 includes at least two rigid finger brackets 84, each of which are engageable with the attaching means 14 of a respective finger mount 12. The distal ends of the finger brackets 84 are connected by frame member 86 which extends in the same general direction as the mounting tube 50. An appropriate length spacer 40 is disposed on the centre shaft 18 between the finger mounts 12. Thus, the frame 82 is unitarily operable in the same manner as a single finger 16 of the embodiment shown in FIGS. 4A–4C. A support 88 can be attachable to or formed integrally with the frame member 86 which can be used to support and/or separate articles. The support 88 can be shaped or configured to suit the specific requirement and in this regard, the support 88 shown in FIGS. 7A–7C has several exemplary supporting configurations 89*a*–89*c*. Configuration 89*a* is a hole adapted to receive a portion of the article to be supported/spaced. Configuration 89*b* is a wedge-shaped slot and configuration 89*c* is a plurality of transverse slots. Obviously, the configurations can be repeated and spaced as necessary. Where articles of the same shape and size are to be supported/spaced, the configurations will be the same whereas it is also envisaged that various configurations can be utilized where articles of predetermined different shapes are to be supported/spaced.

Figure 8A:
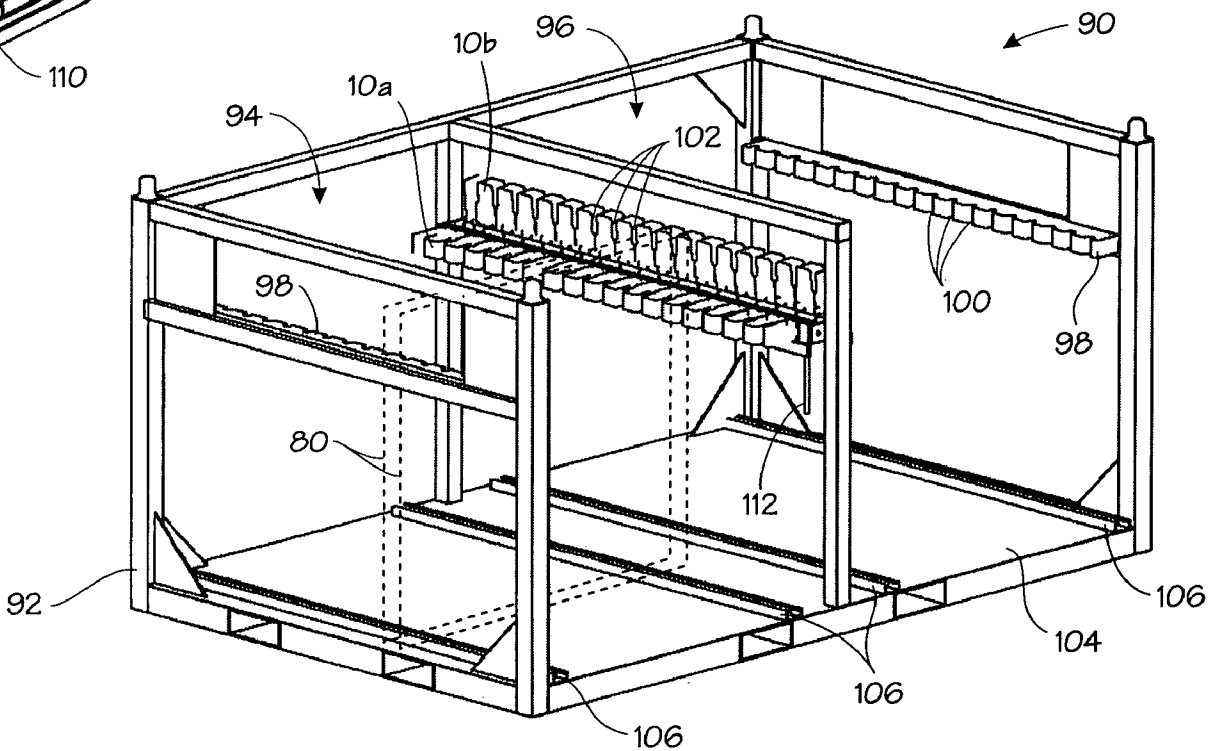
FIG. 8A is a perspective view of a shipping rack showing an application of dual rotatable finger assemblies according to the invention.

FIG. 8A illustrates a practical application of the rotatable finger assembly 10 in a shipping rack 90. The rack 90 includes a frame 92 having two compartments 94, 96, between which dual rotatable finger assemblies 10*a*,10*b* are positioned. The finger assemblies 10*a*,10*b* include a plurality of fingers 16 attached to respective finger mounts 12 (see FIG. 8B) which are individually rotatable as aforesaid. The fingers 16 have a profile similar to the profile of fingers 16*a* in FIG. 6 having a reduced axial width section. Opposite each assembly 10*a*,10*b* there is a fixed spacer 98 having grooves 100 which correspond to the separations 102 formed between the adjacent reduced axial width sections of fingers 16. If desired, similar fixed spacers (not shown) can be positioned on the floor 104 of the rack 90 within channels 106. Although additional rotatable finger assemblies could be used, fixed spacers provide a cheaper alternative.

The rack 90 is designed to accommodate a plurality of planar articles 80 generally vertically in each compartment 94,96. Starting from empty, the fingers 16 of each assembly 10*a*,10*b* are positioned in an upright locked position as shown by assembly 10*b*. A first planar article 80 is positioned against the fixed spacer 98 in a selected groove 100 and the pair of fingers 16 opposite the said groove are rotated and locked into their horizontal position (as shown by assembly 10*a*), thus engaging an edge portion of the article 80 in the respective separation 102 between the reduced width sections of the respective fingers 16. (Of course, the first finger 16 could have been initially rotated into its locked horizontal position prior to positioning the planar article 80 whereafter the second finger 16 of the pair would be subsequently rotated to engage and retain the edge portion of the article 80 within the separation between the pair). Additional planar articles are sequentially positioned with the subsequent finger being rotated into its locked horizontal position to engage and retain the edge portion of each next article 80. Thus, due to the ability of the fingers 16 to rotate individually from a generally upright position, it is not necessary to have the articles lowered vertically and inserted within the spacings (which can be problematic with heavy and/or fragile articles) as would be required if the spacers (fingers) were horizontally fixed. Furthermore, the articles 80 are sequentially held in position as they are introduced. Once the last planar article 80 is locked in place with the last finger, the entire rack 80 can then be transported to the destination/user location. Unloading of the rack 80 may then take place in a generally reverse sequence by rotating the outermost finger from its locked horizontal position to its locked upright and "out of the way" position so that the article 80, once moved out of the groove(s) 100 of the fixed spacer(s), can be removed in a direction which is generally perpendicular to its planarity. Thus, the articles 80 can be removed one at a time with the remaining articles retained in safe, supported and spaced relation.

Figure 8B:
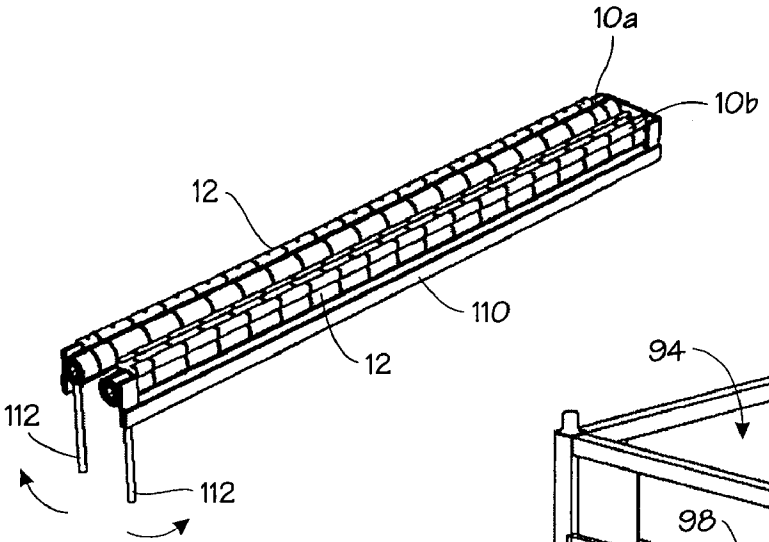
FIG. 8B is a reverse perspective detail of the dual rotatable finger assemblies with the fingers removed for clarity.

To facilitate simultaneous return of all of the fingers 16 into their upright position, an optional reset bar 110 may be provided as shown best in FIG. 8B. The reset bar 110 is mounted generally concentrically with each assembly 10*a*, 10*b* and is rotatable by means of a lever 112, for example. The bar is engageable with the fingers 16 or the finger attachment means 14 of the finger mounts 12. When it is desired to return any and all fingers 16 which are horizontally disposed as shown by assembly 10*a* to their upright positions as shown by assembly 10*b*, the lever 112 is rotated so as to cause the bar 110 to engage the fingers 16 whereby continued rotation of the lever 112 will return the fingers 16 simultaneously to their upright positions.

Figure 9B:
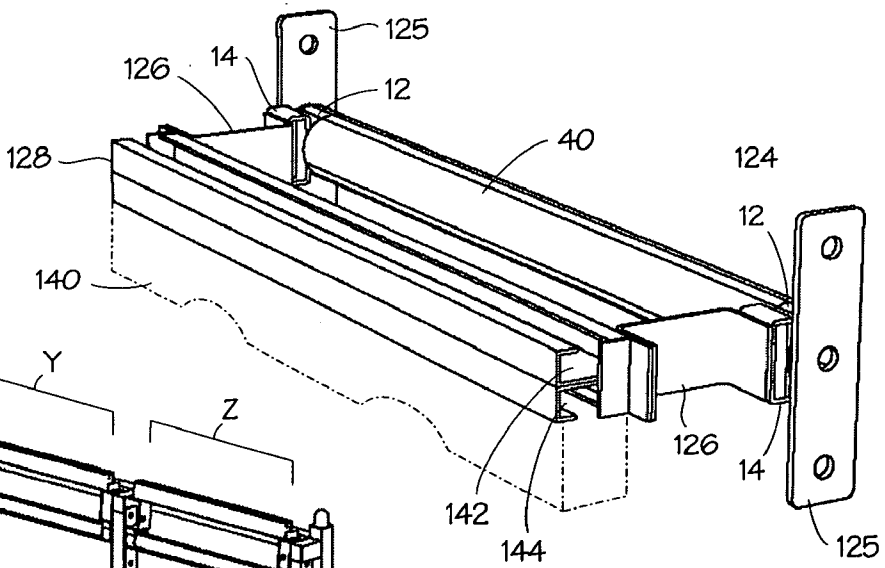
FIG. 9B is a perspective detail of one of the rotatable finger assemblies shown in FIG. 9A with the spacer/support removed for clarity.
Figure 9A:
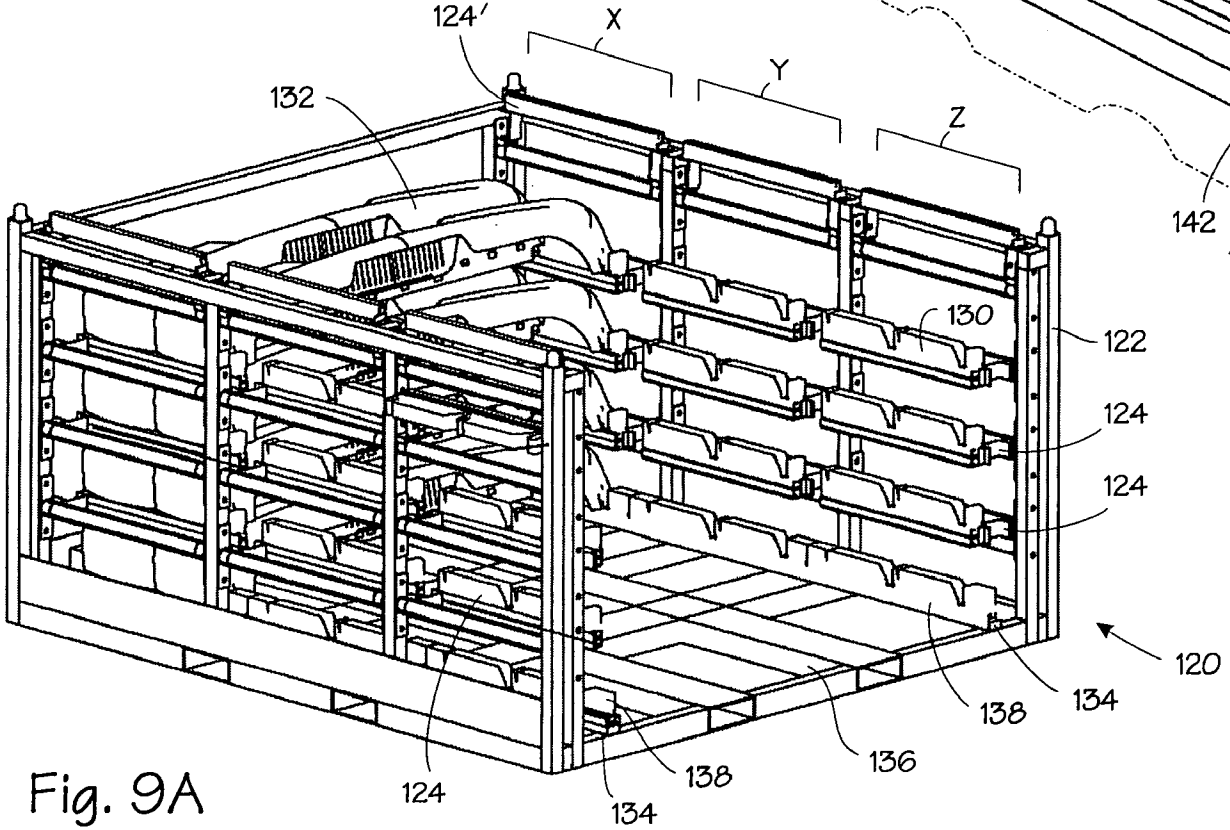
FIG. 9A is a perspective view of an alternate shipping rack showing another application of the rotatable finger assembly.

FIG. 9A illustrates a practical application of a variation the rotatable assembly 81 of FIGS. 7A–7C in another shipping rack 120. The rack 120 includes a frame 122 to which is attached a plurality of rotatable assemblies 124, shown individually and more specifically in part in FIG. 9B. Assembly 124 has a pair of finger mounts 12 spaced apart by spacer 40. The assembly 124 can be mounted to a pair of brackets 125 which can facilitate mounting of the assemblies 124 within the rack 120. A rigid finger bracket 126 extends from the finger attachment means (C-channel) 14. A frame member 128 connects the distal ends of the rigid finger brackets 126. The frame member 128 is adapted to receive a supporting spacer 130 which has been configured in accordance with the type of article 132 to be transported. In the embodiment illustrated in FIG. 9B, the article 132 is fascia for an automobile bumper, two of which are supported/spaced at their ends on each pair of rotatable assemblies disposed on opposite sides of the rack 120. In the rack 120 of FIG. 9A, there are three vertical series X,Y,Z of paired assemblies 124. A pair of channels 134 on the floor 136 of the rack 120 may be adapted to receive fixed supporting spacers 138 as there is usually no need for them to be rotated out of the way during loading and unloading operations.

In a loading sequence, all of the rotating assemblies 124 are positioned in their upright, out of the way, positions as shown at 124'. A first pair of articles 132 are disposed on the lowermost and rearwardmost fixed supporting spacers 138. The pair of rotating assemblies 124 which are vertically adjacent are rotated and locked into their generally horizontal position thereby presenting their respective supporting spacers 130 into which can be placed another pair of articles 132. This step is repeated until all of the pairs of rotating assemblies 124 in series X are filled. Series Y and Z are similarly filled whereupon the entire rack 120 can be transported. The unloading sequence is generally the reverse wherein as each pair of articles 132 are removed, their supporting pair of rotating assemblies 124 are rotated out of the way (to 124') to permit ease of access to lower pairs of articles.

As aforesaid, the shape of respective supporting spacers 130 is made to conform to the article 132 being supported/spaced. It is contemplated that an appropriately configured spacer 140 (shown in phantom in FIG. 9B) can depend from the frame member 128 to provide additional bracing to any articles below the subject rotatable assembly. In this regard, the frame member 128 can include upper and lower channels 142,144 so as to accommodate portions of the upper supporting spacer 130 and lower spacer 140, respectively.

The fingers and supports mentioned above can be made of any material appropriate for the circumstances. Preferably, the material will have some resilience to absorb vibrations or minor impacts yet will be sufficiently stiff to maintain their separation or supporting functions or the fingers/supports can be made of a lightweight rigid material which is coated to achieve these properties. The material should not be damaging to the article which it is to contact. Preferred materials can include rubber and foamed material but can also be made of metal.

While there has been shown and described herein a rotatable finger and frame assembly, it will be appreciated that various modifications and or substitutions may be made thereto without departing from the spirit and scope of the invention. It is to be understood that while the orientation of the embodiments shown and described herein are generally horizontal with the rotation occurring in a generally vertical plane, depending on the nature of the specific application, the orientation can be at any angle, including vertical where rotation occurs in a generally horizontal plane.

I claim:

1. A rotatable finger assembly for use in spacing, separating or supporting one or more articles comprising:

a plurality of independently rotatable fingers mounted for rotation about a common axis, each said finger being rotatable between a first position wherein a surface of the finger is engageable with a surface of one of said articles and a second position wherein said surface of the finger is pivoted away from said surface of said one of said articles, said first position of each finger being angularly the same as every other said finger, each said finger having a second surface engageable with a surface of an adjacent article and wherein when said finger is rotated to said second position, said second surface is pivoted away from said surface of said adjacent article, said fingers being mounted about said common axis on a finger mount having a central aperture through which a central shaft is disposed, wherein said central shaft has a longitudinal spline and said aperture of said finger mount has an internal recess extending partially circumferentially therein in which said spline is circumferentially moveable.

2. The rotatable finger assembly as claimed in claim 1, wherein said surface of said finger has a profile which conforms substantially to the profile of said surface of said one of said articles.

3. The rotatable finger assembly as claimed in claim 1, further comprising stop means for limiting rotation of each finger between said first and second positions.

4. The rotatable finger assembly as claimed in claim 1, wherein said aperture of said finger mount includes a first longitudinally extending groove at one extent of said recess in which said spline is lockingly engageable when said finger is in said first position.

5. The rotatable finger assembly as claimed in claim 4, wherein said aperture of said finger mount includes a second longitudinally extending groove at the opposite extent of said recess in which said spline is lockingly engageable when said finger is in said second position.

6. The rotatable finger assembly as claimed in claim 5, wherein said first and second longitudinally extending grooves are spaced-apart circumferentially more than 90°

7. The rotatable finger assembly as claimed in claim 1, further comprising a spacer positioned between one or more adjacent pairs of finger mounts.

8. The rotatable finger assembly as claimed in claim 1, wherein all said fingers have the same shape.

9. The rotatable finger assembly as claimed in claim 1, wherein one or more of said fingers each has a slot for engaging an edge of one of said articles.

10. The rotatable finger assembly as claimed in claim 1, wherein adjacent fingers are shaped to accommodate a portion of one of said articles therebetween when said fingers are in said first position.

11. The rotatable finger assembly as claimed in claim 1, wherein two or more said fingers are joined to provide a supporting surface for one or more of said articles.

12. A transportation or shipping package comprising one or more pairs of rotatable finger assemblies as claimed in claim 11 used for spacing, separating or supporting said one or more articles contained therein, said pair being disposed on opposite inner walls of said package.

13. A transportation or shipping package comprising at least one rotatable finger assembly as claimed in claim 1 used for spacing, separating or supporting said one or more articles contained therein.

14. The transportation or shipping package as claimed in claim 13 wherein said at least one rotatable finger assembly is positioned horizontally along an inner vertical wall of said transportation or shipping package.

15. A rotatable finger assembly, for use in spacing, separating or supporting one or more articles comprising:

a plurality of independently rotatable fingers mounted for rotation about a common axis, each said finger being rotatable between a first position wherein a surface of the finger is engageable with a surface of one of said articles and a second position wherein said surface of the finger is pivoted away from said surface of said one of said articles, said first position of each finger being augularly the same as every other said finger, each said finger having a second surface engageable with a surface of an adjacent article and wherein when said finger is rotated to said second position, said second surface is pivoted away from said surface of said adjacent article, said fingers being mounted about said common axis on a finger mount having a central aperture through which a central shaft is disposed, and wherein said fingers are removable from said finger mounts for replacement with fingers having different surface profiles for accommodating different shaped articles.

16. A transportation or shipping package comprising:

at least one rotatable finger assembly for spacing, separating or supporting one or more articles, each said rotatable finger assembly comprising:

a plurality of independently rotatable fingers mounted for rotation about a common axis, each said finger being rotatable between a first position wherein a surface of the finger is engageable with a surface of one of said articles and a second position wherein said surface of the finger is pivoted away from said surface of said one of said articles, and one or more fixed spacers spaced from said at least one rotatable finger assembly against which each of said one or more articles are braced.

* * * * *